US005365814A

United States Patent [19]

Irikura

[11] Patent Number: 5,365,814

[45] Date of Patent: Nov. 22, 1994

[54] SHREDDING DEVICE FOR PAPER WEB USED IN THE MANUFACTURE OF CIGARETTES WITH FILTERS

[75] Inventor: Takayuki Irikura, Tokyo, Japan

[73] Assignee: Japan Tobacco Inc., Tokyo, Japan

[21] Appl. No.: 80,129

[22] Filed: Jun. 23, 1993

[30] Foreign Application Priority Data

Jun. 24, 1992 [JP] Japan ..... 4-165878

[51] Int. Cl.[5] ..... B26D 1/40; B26D 1/43

[52] U.S. Cl. ..... 83/74; 83/171; 83/344

[58] Field of Search ..... 83/74, 344, 506, 503, 83/171

[56] References Cited

U.S. PATENT DOCUMENTS

| | | | |
|---|---|---|---|
| 3,186,275 | 6/1965 | Obenshain | 83/170 |
| 3,691,810 | 9/1972 | Tadeusz | 83/344 X |
| 3,731,575 | 5/1973 | Gelin | 83/344 |
| 4,763,637 | 8/1988 | Mayer | 83/74 X |
| 5,022,295 | 6/1991 | Stemmler | 83/171 X |

FOREIGN PATENT DOCUMENTS

| | | |
|---|---|---|
| 61-54559 | 11/1986 | Japan . |
| 63-43077 | 8/1988 | Japan . |

*Primary Examiner*—Richard K. Seidel
*Assistant Examiner*—Kenneth E. Peterson

[57] ABSTRACT

The shredding device for paper web according to the present invention is equipped with a receiving drum, the peripheral surface thereof being formed as a suction surface, a drum shaft which is arranged in parallel to the receiving drum, a bladed drum which is mounted on the drum shaft, a pair of free rollers which are rotatably mounted via bearings on the drum shaft at both sides of the bladed drum and which have a larger diameters than the bladed drum, a pair of rocking arms which are free to rock and which support both ends of the drum shaft, a pair of air cylinders which urge these rocking arms toward the receiving drum, and a control system which increases the air pressure of the air cylinders according to the thermal expansion of the free rollers and displaces the axes of the free rollers with respect to the axis of the drum shaft through the bearings.

10 Claims, 8 Drawing Sheets

SHREDDING DEVICE FOR PAPER WEB USED IN THE MANUFACTURE OF CIGARETTES WITH FILTERS

BACKGROUND OF THE INVENTION

1. Field of the Invention

The present invention relates to a shredding device which is incorporated in a filter attachment designed to connect cigarettes and filters and which shreds a paper web to produce paper pieces used for connecting cigarettes and filters.

2.Description of Related Art

This type of filter attachment is provided with a non-contact shredding device which is disclosed in the publication of examined Jp patent application No. S61-54559. This publicly known shredding device includes a receiving drum and a bladed drum. The bladed drum has a plurality of shredding blades arranged equidistantly on the peripheral surface thereof and a pair of free rollers installed on both ends. These free rollers have larger diameters than that of the bladed drum and they are rotated while being contact with the receiving drum.

With the receiving drum and the bladed drum being rotated in the opposite direction from each other, a paper web is supplied between the receiving drum and the bladed drum. When the paper web passes through these drums, the shredding blades of the bladed drum shred the paper web into paper pieces of a specified length without contacting the peripheral surface of the receiving drum.

Thus, the shredding blades of the bladed drum do not collide with the receiving drum at the time of shredding the paper web, making it possible to prevent shredding noises caused by such a collision and also to prevent damages to the receiving drum or the shredding blades.

In the non-contact shredding device described above, the shredding performance heavily depends on the size of the gap between the shredding blades and the receiving drum when the shredding blades approach most closely to the peripheral surface of the receiving drum. For this reason, the gap must be maintained at a constant dimension to maintain the desired shredding performance.

In recent years, the required rotational speed of the receiving drum and the bladed drum is increasing with increasing operation speed of the filter attachment. As the rotational speed of the drums increases, the free rollers, which rotate in contact with the receiving drum at all times, tend to overheat due to frictional heat. When the temperature of the free rollers rises, the outside diameters of the free rollers increase due to thermal expansion. As a result, the foregoing gap increases, preventing the shredding blades from reliably shredding the paper web.

SUMMARY OF THE INVENTION

An object of the present invention is to provide a shredding device which is capable of controlling the increase of the above-mentioned gap even if the free rollers thermally expand, thus permitting stable shredding operation for the paper web.

The object described above is achieved by a shredding device according to the present invention, the shredding device being equipped with a first drum rotatably arranged and having a peripheral surface for carrying a paper web as the first drum rotates, and shredding means for shredding the paper web into paper pieces of a specified length, in cooperation with the first drum, the shredding means including a common shaft arranged in parallel to the first drum, a second drum mounted on the common shaft, the second drum being rotated with the common shaft in the opposite direction from the first drum, and a pair of free rollers arranged at both sides of the second drum and having a larger outside diameter than the second drum, said pair of free rollers being rotated while contacting with the peripheral surface of the first drum as the first drum rotates, mounting means for mounting the free rollers on the common shaft and allowing the displacement of the axis of each free roller with respect to the axis of the common shaft, a plurality of shredding blades arranged circumferentially on the peripheral surface of the second drum at equal intervals, the shredding blades passing the first drum with a specified gap between themselves and the peripheral surface of the first drum as the second drum is rotated and shredding the paper web on the first drum into individual paper pieces while passing, supporting means for supporting the second drum and the pair of free rollers so that they are allowed to move toward or away from the peripheral surface of the first drum, and urging means for urging the second drum and the pair of free rollers toward the peripheral surface of the first drum and pressing the pair of free rollers against the peripheral surface of the first drum with a specified force, detecting means for detecting an increase in the outside diameter of the free rollers, and controlling means for controlling the urging force of the urging means in accordance with an increase in the outside diameter of the free rollers, and adjusting the eccentric distance between the axes of the free rollers and the axis of the common shaft by means of the mounting means.

According to the shredding device described above, whenever an increase in the outside diameter of the free rollers is detected by the detecting means, the controlling means increases the pressing force applied to the free rollers. Increasing the pressing force causes the distance between the point of contact of the first drum and the free rollers and the axes of the free rollers to be reduced through the mounting means. As a result, the foregoing gap is kept constant.

Hence, even if the free rollers thermally expand and their outside diameters increase, the foregoing gap is always kept constant; therefore, stable paper web shredding can be performed for an extended period of time.

BRIEF DESCRIPTION OF THE DRAWINGS

The present invention will be better understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
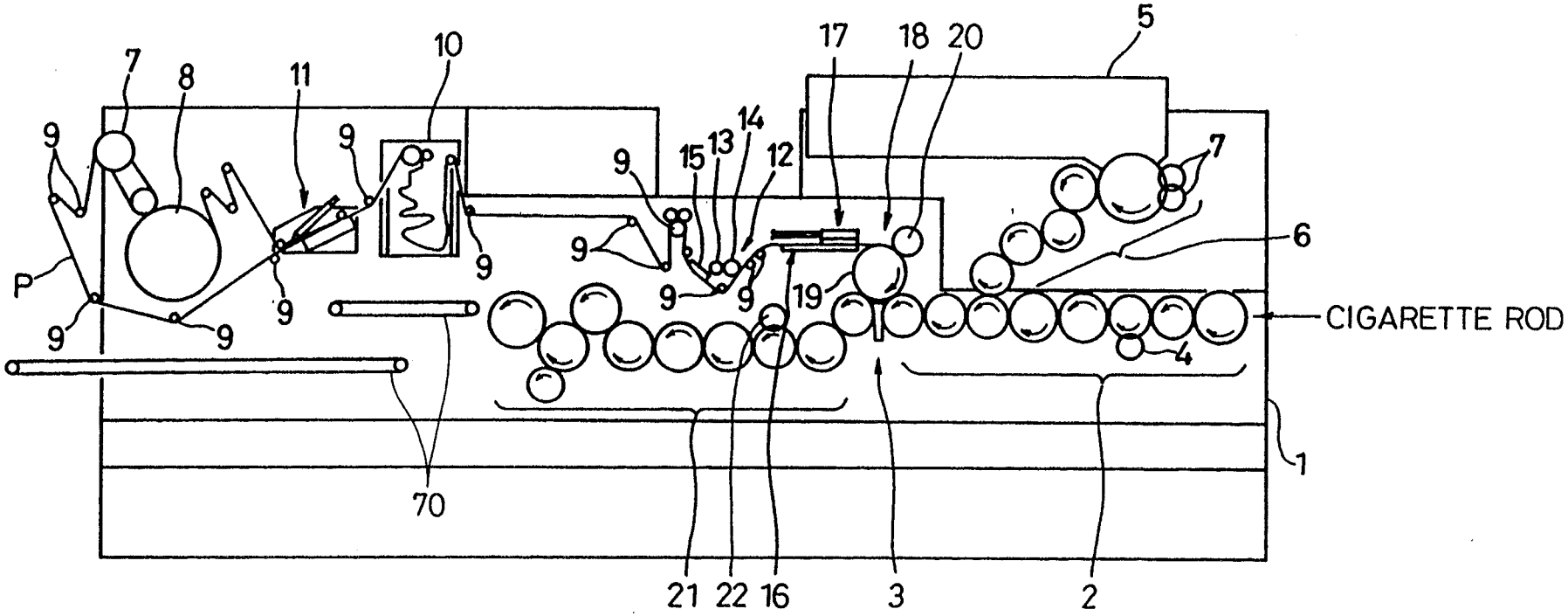
FIG. 1 is a schematic front view of a filter attachment.

As shown in FIG. 1, a filter attachment is equipped with a mainframe 1, a drum train 2 being provided on the right side of the mainframe 1. The drum train 2 extends to a rolling section 3 on the left as observed in FIG. 1.

The drum train 2 comprises many drums and the peripheral surface of each drum has many grooves (not shown) which are provided equidistantly. A cigarette rod produced by a cigarette manufacturing machine (not shown) is supplied to a groove of the grooved drum which is located at the right end of the drum train 2, the cigarette rod having a length which corresponds to a double length cigarette.

Cigarette rods supplied to the drum train 2 are successively transferred to the grooves of the grooved drums positioned at left by the rotating grooved drums of the drum train 2 as publicly known, thus being carried toward the rolling section 3. A grooved dream lying in the middle of the drum train 2 has a rotary knife 4 and the rotary knife 4 cuts the cigarette rod, which has been carried in, into individual cigarettes as the grooved drum rotates. After that, the two cigarettes, which have been acquired by cutting the single cigarette rod, are carried toward the above-mentioned rolling section 3. In the course of the carrying process, a specified space is provided between the two cigarettes.

Figure 2:
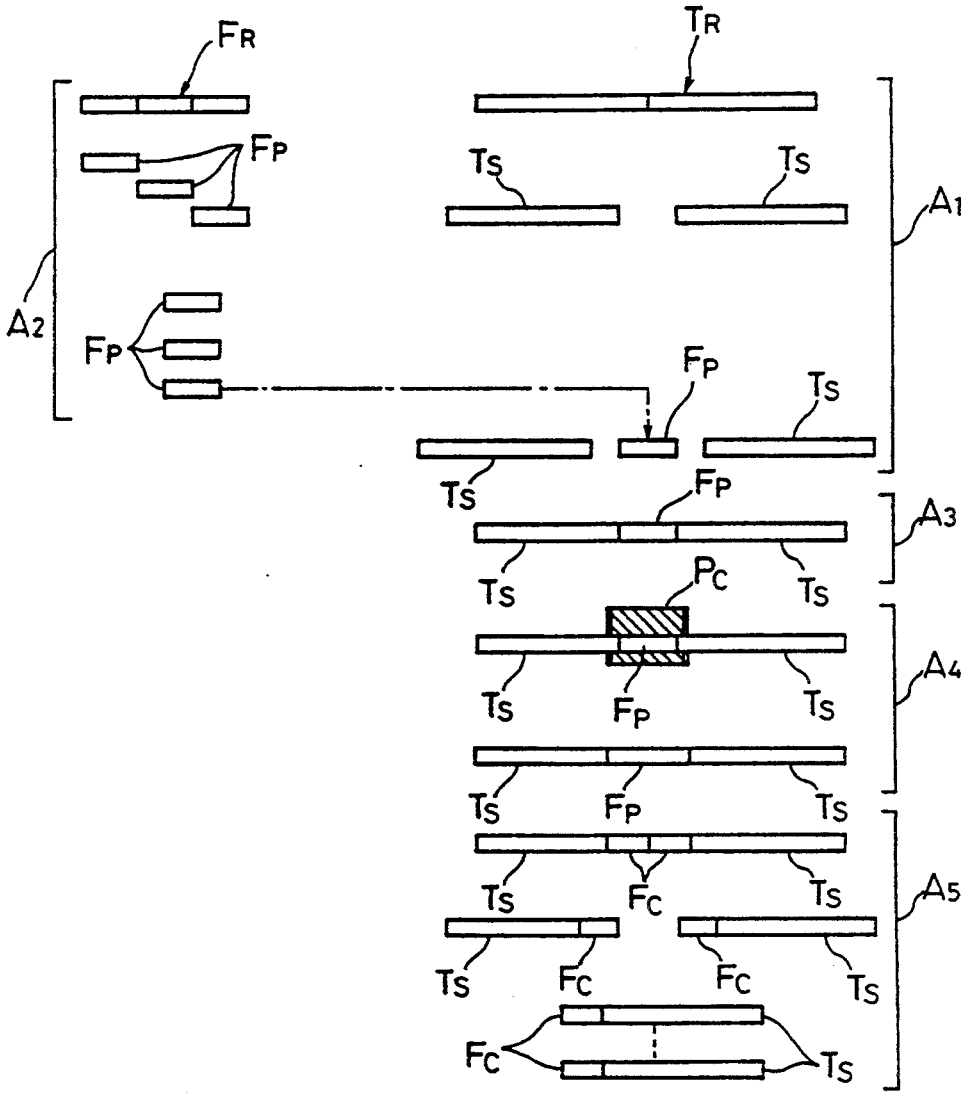
FIG. 2 shows a cigarette and filter rod processing flow in the filter attachment.

In FIG. 2, an area $A_1$ shows a processing flow from a step wherein individual cigarettes are formed from a cigarette rod to a step wherein a specified space is provided between the two cigarettes. In FIG. 2, a reference mark $T_R$ indicates the cigarette rod and a reference mark $T_S$ indicates the cigarettes.

As shown in FIG. 1, above the drum train 2 is provided a hopper 5. The hopper 5 contains many filter rods which are not shown. The hopper 5 and drum train 2 are connected via a drum train 6 which is similar to the drum train 2.

The drum train 6 carries a filter rod, which has been taken out from the hopper 5, to the drum train 2. In the course of the carrying process, the filter rod is equally cut into filter plugs of a specified length, then the filter plugs are supplied between the two cigarettes on the drum train 2.

More specifically, a grooved drum of the drum train 6 located right below the hopper 5 is equipped with, for example, two rotary knives 7. The rotary knives 7 equally cut a filter rod, which is carried in as the grooved drum rotates, into three filter plugs.

A grooved drum located downstream from the grooved drum with the rotary knives 7 functions as a "grading drum". The three filter plugs obtained from a single filter rod are placed one behind another by the grading drum in the carrying direction. Thus. The three filter plugs passing through the grading drum are fed to the drum train 2 one by one from the grooved drum located at the downstream end of the drum train 6.

Each of the filter plugs supplied to the drum train 2 is arranged between two cigarettes at the aforementioned specified space. After that, the filter plug is carried with the two cigarettes to the rolling section 3.

In FIG. 2, an area A2 shows a processing flow from a step wherein individual filter plugs are acquired from a filter rod to a step wherein a filter plug is placed between the two cigarettes $T_S$. In FIG. 2, a reference mark $F_R$ indicates the filter rod and a reference mark $F_P$ indicates the filter plug, the filter plug $F_P$ having a length which is equal to double length filter chips, each filter chip being to be attached to one cigarette $T_S$.

On the drum train 2, the two cigarettes $T_S$ with the filter plug $F_P$ positioned between them are moved so that they come in close contact with the ends of the filter plug $F_P$ when they pass through the last grooved drum of the drum train 2. This processing is shown by an area $A_3$ in FIG. 2.

Hence, the two cigarettes $T_S$ are fed with the single filter plug $F_P$ from the drum train 2 to the rolling section 3.

On the other hand, a paper piece with glue on is also fed to the rolling section 3. The paper piece feeding system extends from the top left end of the mainframe 1 to the rolling section 3 in FIG. 1.

The feeding system has a pair of paper rolls 7 and 8 at the top left of the mainframe 1. These paper rolls 7 and 8 comprise reels wrapped with paper webs $P_w$ in multiple layers. The width of the paper web $P_w$ is sufficiently larger than the length of the filter plug $F_P$.

Under the condition shown in FIG. 1, the paper web $P_w$ is drawn out from the paper roll 7, and the drawn-out paper web $P_w$ is led to the rolling section 3 while it is guided by multiple guide rollers 9 which define the feeding route. In the middle of the feeding route, there is a reservoir 10 for the paper web $P_w$ on the side of the paper rolls 7 and 8. The reservoir 10 is used to absorb a difference between the consuming speed of the paper web $P_w$ on the rolling section 3 and the feeding-out speed of the paper wed $P_w$ on the paper roll side when the filter attachment is shut down or to temporarily accumulate the paper web $P_w$ prior to the connection of the paper web $P_w$.

The following describes the connection of the paper web $P_w$. A connecting section 11 is provided on the upstream side of the reservoir 10. The leading end of tile paper web $P_w$ drawn out from the other paper roll 8 is led to the connecting section 11 in advance. If the paper web $P_w$ is stored in the reservoir 10, when the paper web $P_w$ of the paper roll 7 is consumed and then the trailing end reaches the connecting section 11, the drawing out of the paper web $P_w$ from the paper roll 7 is stopped, then the leading end of the paper web $P_w$ drawn out from the paper roll 8 can be connected to the trailing end of the paper web $P_w$. Even while the connection is being performed, the paper web $P_w$ continues to be fed from the reservoir 10 to the rolling section 3.

In the feed path of the paper web $P_w$, a gluing device 12 is provided on the side of the rolling section 3. The gluing device 12 comprises an intermediate roller 13 which rotates while it is partially immersed in the glue of a glue container which is not shown, and a transfer roller 14 which rotates while being in contact with the intermediate roller 13 on one side and which rotates while being in contact with one surface of the paper web $P_w$ on the other side.

The glue which is applied through the glue container to the peripheral surface of the intermediate roller 13 is transferred from the intermediate roller 13 to the transfer roller 14. At this time, the glue is spread to a specified thickness and applied to the peripheral surface of the transfer roller 14 then it is transferred to one surface of the paper web $P_w$ from the transfer roller 14. The details of the gluing device 12 are disclosed in the publication of examined JP patent application No. S63-43077.

In the feeding route of the paper web $P_w$, there are a pre-heater 15 and a post-heater 16 with the gluing device 12 located between them. These pre-heater 15 and the post-heater 16 have guide plates For the paper web $P_w$ and heat-generating sheets attached to the surfaces of the guide plates, the guide plates and heat-generating sheets defining the carrying surface of the paper web $P_w$. As it is obvious from FIG. 1, the pre-heater 15 heats the surface of the paper web $P_w$ to which the glue is applied, while the post-heater 16 heats the other surface of the paper web $P_w$.

In the case of this embodiment, the post-heater 16 is combined with a hot-air heater 17 which blows hot air to the glue applied to the paper web $P_w$, thus effectively pre-drying the glue of the paper web $P_w$.

A shredding device 18 is provided at the end of the feeding route of the paper web $P_w$. This shredding device 18 cuts the paper web $P_w$ with the glue on into paper pieces of a specified length, then the paper pieces are fed to the rolling section 3.

The shredding device 18 is equipped with a receiving drum 19, the peripheral surface of the receiving drum 19 being formed as a suction surface for suction of air from outside. In the vicinity of the receiving drum 19, there is a bladed drum 20, and these drums 19 and 20 are rotated at the same circumferential speed but in the opposite directions from each other.

When the paper web $P_w$ with the glue on reaches the receiving drum 19, the surface of the paper web $P_w$ with no glue on 1s suctioned to the suction surface of the receiving drum 19 and it is supplied to the rolling section 3 as the receiving drum 19 rotates. Although it is not shown in FIG. 1, the bladed drum 20 has a plurality of shredding blades arranged circumferentially at equal intervals on its peripheral surface. Hence, the paper web $P_w$ suctioned to the peripheral surface of the receiving drum 19 passes between the receiving drum 19 and the bladed drum 20 as the receiving drum 19 rotates. At this time of passing, the paper web $P_w$ is cut into pieces of a specified length by the shredding blades of the rotating bladed drum 20. As a result, paper pieces are formed on the receiving drum 19. After that, the individual paper pieces are supplied to the rolling section 3 in succession as the receiving drum 19 rotates with the paper pieces suctioned to the receiving drum 19.

When the two cigarettes $T_S$ are supplied with the filter plug $F_p$ from the end of the aforementioned drum train 2 to the rolling section 3, these cigarettes $T_S$ and the filter plug $F_P$ roll between the receiving drum 19 and the rolling section 3. Also, when a paper piece is supplied to the rolling section 3, the paper piece is attached to a section extending from the end of one cigarette $T_S$ to the end of the other cigarettes $T_S$ with the filter plug $F_P$ between them, and the paper piece is wrapped around the cigarettes and the filter plug as the cigarettes and the filter plug rotate. As a result, the two cigarettes $T_S$ and the filter plug $F_P$ are interconnected by the ring-like paper piece, thus producing a double filter cigarette which is equivalent to two filter cigarettes. After that, the double filter cigarette is supplied from the rolling section 3 to a drum train 21. The drum train 21 extends toward the left end of the mainframe 1.

By the time the paper piece is glued onto the two cigarettes $T_S$ and the filter plug $F_P$, the suction applied to the paper piece by the receiving drum 19 has, of course, been released.

An area $A_4$ in FIG. 2 shows a processing flow from the supply of a paper piece to the rolling section 3 to the wrapping of the paper piece. A reference mark $P_c$ indicates the paper piece, and the surface of the paper piece $P_C$ to which the glue has been applied is shown hatched.

After the double filter cigarette is supplied from the rolling section 3 to the drum train 21, it is carried on the grooved drums of the drum train 21. One of the grooved drums of the drum train 21 has a rotary knife 22. When the double filter cigarette passes through the rotary knife 22, the knife cuts the double filter cigarette at the middle of its filter plug. As a result, two cigarettes with filter chips or two filter cigarette are obtained from one double filter cigarette on the drum 21.

After that, the two filter cigarettes are transferred from the end of the drum train 21 to a conveyer unit 70. The conveyer unit 70 carries the filter cigarettes to a packing machine (not shown) in the next stage, the filter cigarettes being arranged in the same direction while they are being carried in the conveyer unit 70.

An area $A_5$ in FIG. 2 shows the processing flow from cutting the double filter cigarette, to carrying them to the packing machine. In FIG. 2, a reference mark $F_C$ denotes a filter chip obtained by cutting the filter plug $F_P$. (*e)

Figure 3:
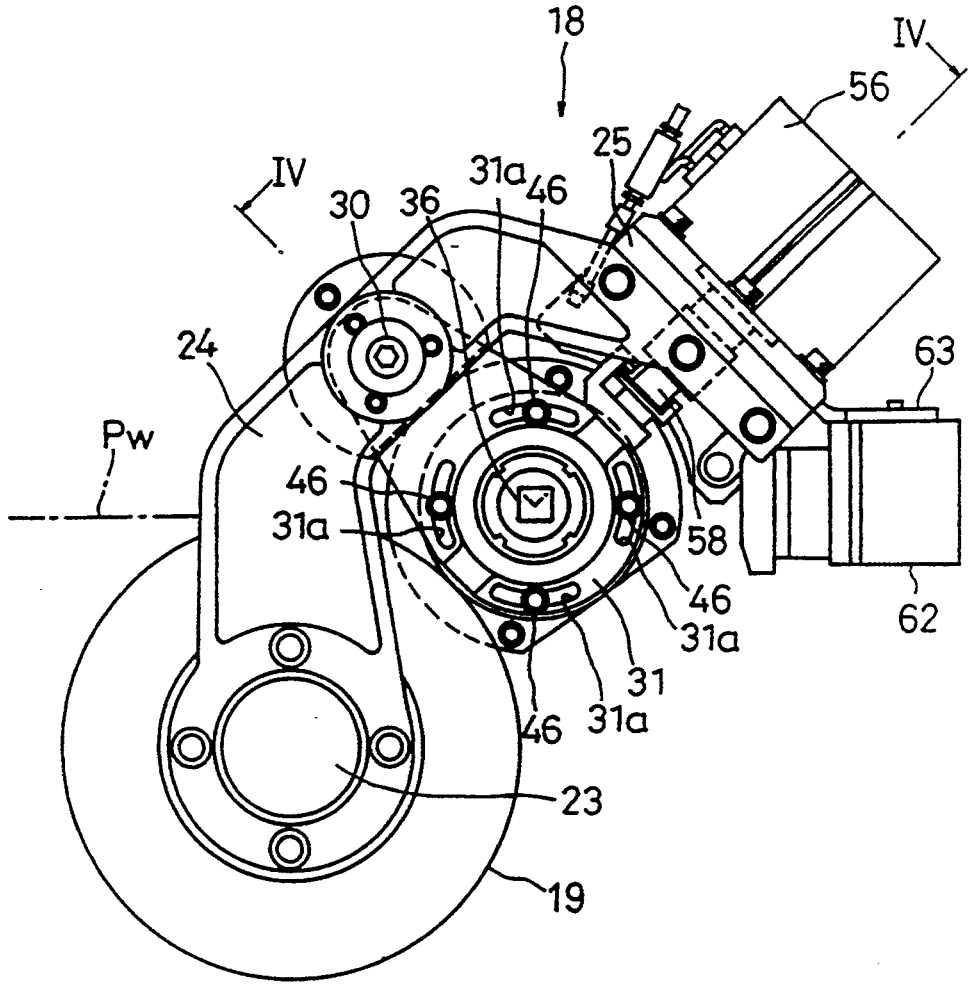
FIG. 3 is an enlarged front view of a shredding device in the filter attachment.
Figure 4:
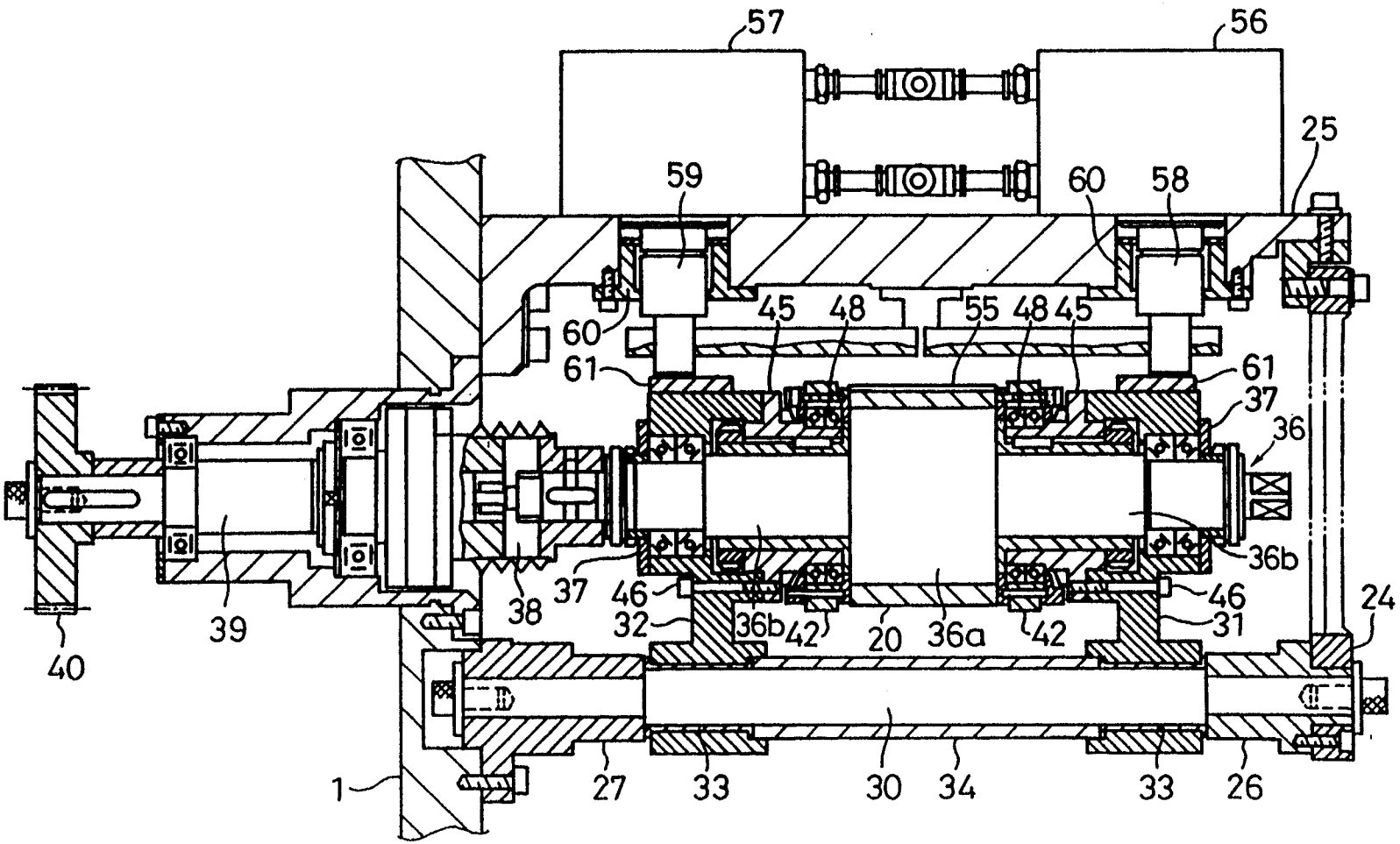
FIG. 4 is a cross-sectional view of the shredding device of FIG. 3 taken along the line IV—IV

Referring now to FIG. 3 and FIG. 4, the shredding device 18 described above is shown in detail. The following presents the detailed explanation of the configuration of the shredding device 18.

As shown in FIG. 3, the receiving drum 19 has a drum shaft 23, one end of the drum shaft 23 being rotatably supported by the mainframe 1, while the other end being rotatably supported by one end of a support arm 24. Although it is not shown, one end of the drum shaft 23 is connected to a driving source to receive motive power from the driving source so that the drum shaft 23, i.e., the receiving drum 19, is rotated in a specified direction.

The support arm 24 is shaped so that its one end stands up and extends diagonally upward to the right; then further extends diagonally downward. The support arm 24 is located in parallel to the mainframe 1, and a specified distance is provided between the support arm 24 and the mainframe 1.

The other end of the support arm 24 is fixed To the mainframe 1 via a bracket 25. The bracket 25 projects from the mainframe 1 as it is obvious from FIG. 4.

A fixed shaft 30 extends from the central section of the support arm 24 to the mainframe 1. The fixed shaft 30 extends in parallel to the drum shaft 23 of the receiving drum 19, its both ends being supported by the support arm 24 and the mainframe 1 via tubular holders 26 and 27.

A pair of rocking arms 31 and 32 are mounted on the fixed shaft 30, and the upper ends of these arms 31 and 32 are rotatably supported via plain bearings 33. A spacer sleeve 34 is mounted on the fixed shaft 30 at between the top ends of the rocking arms 31 and 32.

At the lower ends of the rocking arms 31 and 32, both ends of a drum shaft 36 are rotatably supported via rolling bearings 37. The drum shaft 36 extends in parallel to the drum shaft 23 of the receiving drum 19 and its central part is formed as a large-diameter portion 36*a*.

One end of the drum shaft 36 located on the side of the mainframe 1 projects from the rocking arm 32 toward the mainframe 1 and it is connected to an input shaft 39 via an Oldham coupling 38. The Oldham coupling 38 and the input shaft 39 are supported by the mainframe 1.

An input gear 40 is mounted on the input shaft 39, and the input gear 40 transmits motive power via a gear train which is not shown. Hence, when the input gear 40, i.e., the input shaft 39, is rotated, the rotary force is transmitted to the drum shaft 36 via the Oldham coupling 38. As a result, the drum shaft; 36 is rotated with the input shaft 39. The Oldham coupling 38 has a function that allows motive power to be transmitted from the input shaft 39 to the drum shaft 36 with the rotational speed of the input shaft 39 coinciding with that of the drum shaft 36 even if the rocking arms 31 and 32 rock and cause the axis of the input shaft 39 to disagree with that of the drum shaft 36.

A pair of free rollers 42 are mounted on the drum shaft 36 at both sides of the large-diameter portion 36*a*, i.e., on small-diameter portions 36*b* thereof. These free rollers 42 are made of cemented carbide with a low thermal expansion rate, the mounting structure of one of the free rollers 42 being shown in detail in FIG. 5 and FIG. 6.

Figure 5:
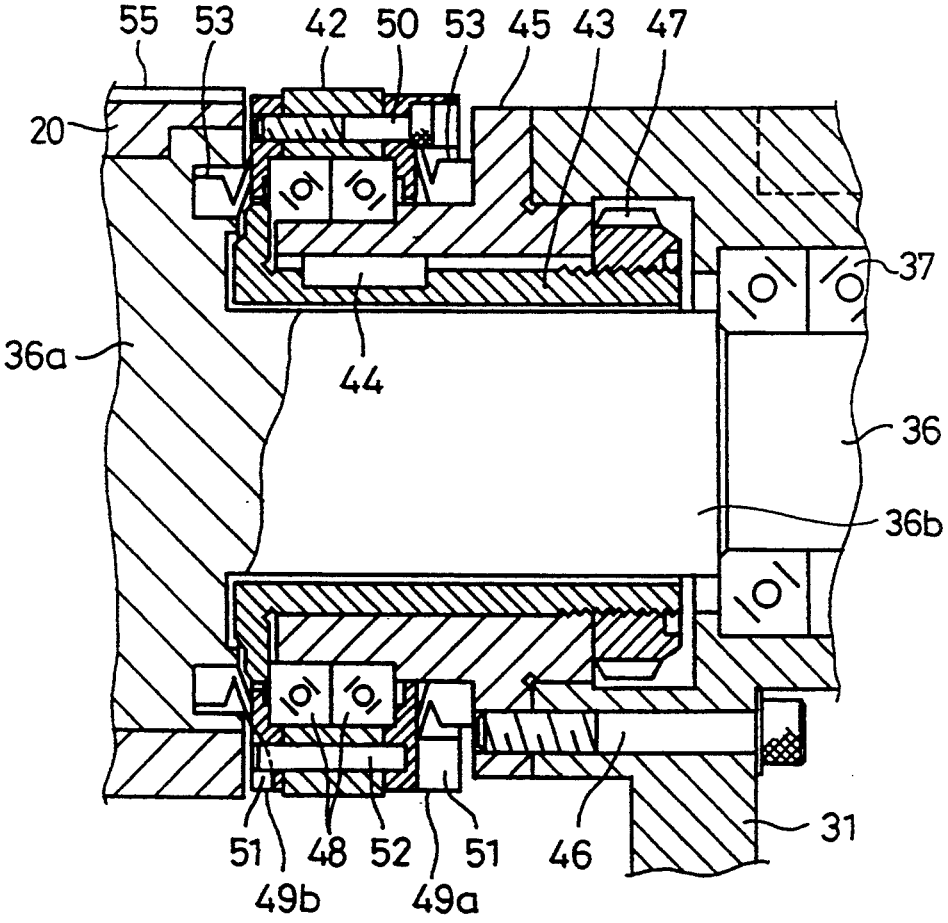
FIG. 5 is an enlarged view of the mounting section of the free rollers of FIG. 4.

As shown in FIG. 5, sleeve 43 surrounds the small-diameter portion 36*b* of the drum shaft 36, and an annular gap is provided between the sleeve 43 and the drum shaft 36. An adjusting holder 45 is mounted on the sleeve 43 via a key 44. As it is obvious from FIG. 6, the adjusting holder 45 has a mounting surface 45*a* for a pair of rolling bearings 48 on its periphery, and the axis of the mounting surface 45*a* is eccentric to the axis of the drum shaft 36. Accordingly, the adjusting holder 45 is mounted eccentrically with respect to the drum shaft 36.

The adjusting holder 45 and the corresponding rocking arm 31 are connected into one piece via a plurality of connecting bolts 46, and these connection bolts 46 are screwed into the adjusting holder 45 through arc slots 31*a* formed in the rocking arm 31 as shown in FIG. 3.

Further, one end of the sleeve 43 on the side of the bearing 37 is formed as a threaded section, the threaded section projecting from the adjusting holder 45. A nut 47 is engaged with the threaded section.

The free rollers 42 is installed on the peripheral surface, i.e., the mounting surface 45*a*, of the adjusting holder 45 via the pair of rolling bearings 48 mentioned above so that they are free to rotate, and they are held between a pair of holder rings 49*a* and 49*b*. These holder rings 49*a* and 49*b* and the free roller 42 are interconnected via a plurality of connecting bolts 50. Hence, the holder rings 49*a* and 49*b* rotate as one piece with the free roller 42.

The holder rings 49*a* and 49*b* are made of a metallic material having good thermal conductivity, each holder ring being provided with a plurality of radiating fins 51 on the end surface which is located opposite from the free roller 42.

The large-diameter portion 36*a* of the drum shaft 36 has an annular groove in its end surface, and the inner surface of the annular groove and the adjusting holder 45 are provided with dust-proof seals 53, respectively. These dust-proof seals 53 contact the holder rings 49*a* and 49*b*, respectively and protect the rolling bearings 48.

Figure 6:
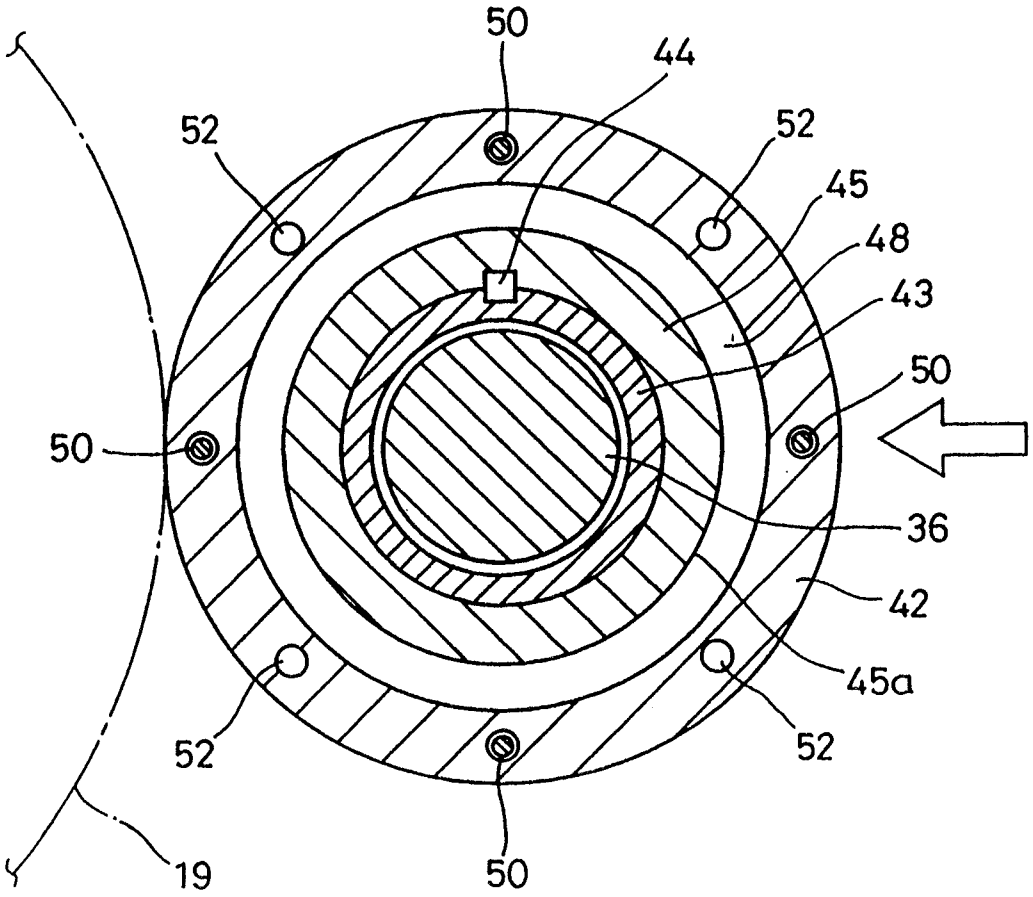
FIG. 6 is a cross-sectional view of the mounting section of FIG. 5.

Further, the free roller 42 incorporate a plurality of heat pipes 52. These heat pipes 52 penetrate the free rollers 42 and both ends thereof go into their corresponding holder rings 49*a* and 49*b*. These heat pipes 52 contain hydraulic fluid sealed under reduced pressure; they are located between the aforementioned connecting bolts 50 as observed in the peripheral direction of the free roller 42 as shown in FIG. 6, and they thermally connect the free roller 42 with the radiating fins 51 via the holder rings 49*a* and 49*b*.

The mounting structure of the other free roller 42 is the same; therefore, the explanation and illustration will be omitted.

The large-diameter portion 36*a* of the drum shaft 36 is provided with the bladed drum 20 mentioned above. Like the free rollers 42, the bladed drum 20 is made of cemented carbide and it has a plurality of shredding blades 55 on its peripheral surface. These shredding blades 55 are arranged equidistantly on the periphery of the bladed drum 20, their edges extending in the axial direction of the drum shaft 36. Although it is not shown, the edge of each shredding blade 55 has a trapezoid section. The trapezoid shape is suited for shredding the paper web $P_w$ without contacting the receiving drum 19.

A pair of air cylinders 56 and 57 are mounted on the aforesaid bracket 25 as shown in FIG. 3 and FIG. 4. Pusher rods 58 and 59 are connected to the piston rods of the air cylinders 56 and 57, respectively, and these pusher rods 58 and 59 penetrate guides 60 in the bracket 25 and extend toward their corresponding rocking arms 31 and 32. The distal ends of the pusher rods 58 and 59 are brought in contact, from sides, with the lower ends of the rocking arms 31 and 32 via patches 61.

Hence, when air pressure is supplied to the pair of air cylinders 56 and 57, the push rods 58 and 59 urge the rocking arms 31 and 32 toward the receiving drum 19. As a result, the pair of free rollers 42 are pressed against the peripheral surface of the receiving drum 19 with a specified pressing force as shown by the arrow in FIG. 6.

When the pair of free rollers 42 rotate while being in contact with the peripheral surface of the receiving drum 19, the bladed drum 20 rotates so that a specified gap, which is sufficiently smaller than the thickness of the paper web $P_w$, is provided between the edges of the shredding blades 55 and the peripheral surface of the receiving drum 19. Thus, even when the receiving drum 19 and the bladed drum 20 are rotated in the opposite directions from each other with the pair free rollers 42 rotating in contact width the receiving drum 19, the shredding blades 55 cut the paper web $P_w$ into paper pieces $P_C$ without touching the peripheral surface of the receiving drum 19.

Figure 7:
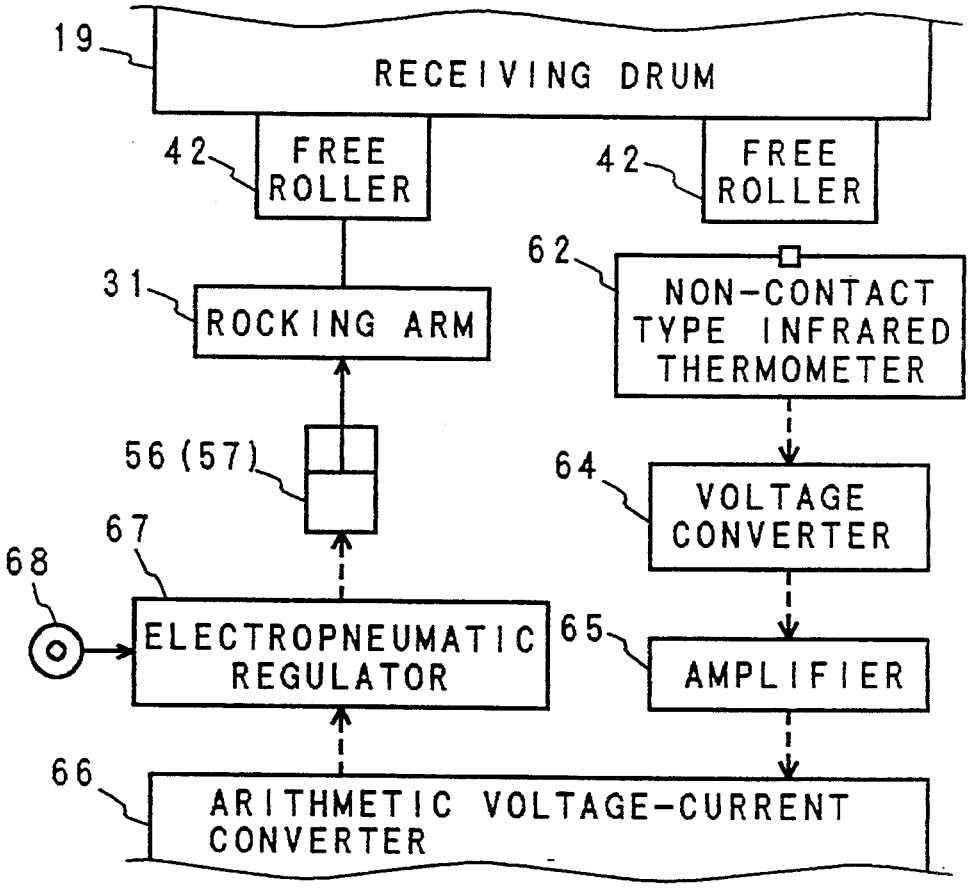
FIG. 7 is a control block diagram of the control of the air pressure of the air cylinder.

The air pressure supplied to the aforesaid air cylinders 56 and 57 is controlled by the control system shown in FIG. 7. The following describes the control system.

The control system is equipped with a non-contact type infrared thermometer 62, and this thermometer 62 is mounted on the bracket 25 via a stay 63 as shown in FIG. 3. The infrared thermometer 62 detects the infrared ray emitted from the free roller 42 to be measured and it determines the temperature of the free rollers 42 based on the level of the detected infrared ray. The infrared thermometer 62, for instance, has a capacity of detecting the temperature of the free rollers 42 within a range of 30° C. to 70° C.

The infrared thermometer 62 is electrically connected to an arithmetic voltage-current converter 66 through a voltage converter 64 and an amplifier 65. Thus, a sensor signal of the temperature sensor 62, that is, the sensor signal which indicates the temperature of the free rollers 42, is converted into a voltage signal by the voltage converter 64, amplified by the amplifier 65, then applied to the voltage-current converter 66.

The voltage-current converter 66 converts the input voltage into an output current according to a specified calculating formula, then supplies the output current to an electropneumatic regulator 67.

Here, when the input voltage of the voltagecurrent converter 66 is taken as Xi and the output current as Xo, then the aforesaid calculating formula is expressed as:

$$Xo = k \cdot Xi \pm B$$

where "k" is a proportion constant and "B" is a bias value.

The electropneumatic regulator 67 is located between the air cylinder 56 (57) and an air supply source 68, and it functions to control the air pressure supplied to the air cylinder 56 (57) according to the output current Xo received from the voltage-current converter 66.

The operation of the aforesaid shredding device 18 will now be described.

A specified air pressure is applied to the air cylinders 56 and 57, and these air cylinders 56 and 57 press the pair of rocking arms 31 and 32, i.e., the pair of free rollers 42, against the rotating receiving drum 19 with a given pressing force. Thus, the prescribed gap is defined between the shredding blade 55 and the peripheral surface of the receiving drum 19 when the shredding blade 55 of the bladed drum 20 approach most closely to the peripheral surface of the receiving drum 19 while the receiving drum 19 and the bladed drum 20 are rotating in the opposite directions from each other.

Under such a condition, when the paper web $P_w$ is fed into the gap between the receiving drum 19 and the bladed drum 20 as previously mentioned, the paper web $P_w$ is cut into paper pieces $P_C$ of a specified length by the wedge effect of the edges of the shredding blades 55 as the paper web passes through the gap. The paper pieces $P_C$ are then fed to the rolling section 3.

While the paper web $P_w$ is being cut, the bladed drum 20 is rotated so that the shredding blades 55 do not contact the receiving drum 19, thus making it possible to prevent noises or damage to the shredding blades 55 during the shredding operation.

In addition, the pair of rocking arms 31 and 32 are always urged toward the receiving drum 19 by the air cylinders 56 and 57; therefore, the pair of free rollers 42 do not move away from the peripheral surface of the receiving drum 19 even if the rotation of the receiving drum 19 develops run-out while the paper web $P_w$ is being cut. In other words, even if the rotation of the receiving drum 19 develops run-out, the rocking arms 31 and 32 rock in response to the run-out so that the pair of free rollers 42 are kept in secure contact with the peripheral surface of the receiving drum 19.

As a result, the aforesaid gap between the shredding blade 55 of the bladed drum 20 and the peripheral surface of the receiving drum 19 is kept at the constant dimension at all times while rotating the drums 19 and 20, thus ensuring secure and stable cutting of the paper web $P_w$. Additionally, the shredding blades 55 of the bladed drum 20 do not bump against the receiving drum 19 and therefore, the edges of these shredding blades 55 do not incur damage.

On the other hand, while the shredding device 18 is in operation, the pair of free rollers 42 are constantly in contact with the receiving drum 19; therefore, the temperature of these free rollers 42 rises from the frictional heat which is responsible for the thermal expansion of the free rollers 42.

The thermal expansion of the free rollers 42 leads to an increase of the gap which is defined between the receiving drum 19 and the shredding blade 55, causing incomplete cutting of the paper web $P_w$.

In the case of the above embodiment, however, the temperature of the free rollers 42 is detected by the infrared thermometer 62 and the air pressure of the air cylinders 56 and 57 is controlled according to the temperature rise in the free rollers 42. This make it possible to keep the foregoing gap constant even when the free rollers 42 develop thermal expansion.

To be more specific on this point, the infrared thermometer 62 detects the temperature of the free rollers 42 and supplies the detected signal as the input voltage Xi to the aforesaid voltage-current converter 66 via the voltage converter 64 and the amplifier 65 as previously described. And the voltage-current converter 66 calculates the output current Xo according to the input voltage Xi and supplies the output current Xo to the electropneumatic regulator 67.

The electropneumatic regulator 67 increases the air pressure in the air cylinders 56 and 57 according to the output current Xo, i.e., the thermal expansion of the free rollers 42, thereby increasing the force of pressing the free rollers 42 against the receiving drum 19.

To increase the pressing force, the rolling bearings 48 of the free rollers 42 are displaced only by the amount that offsets the thermal expansion of the free rollers 42. As a result, the aforesaid gap is kept unchanged.

Figure 8:
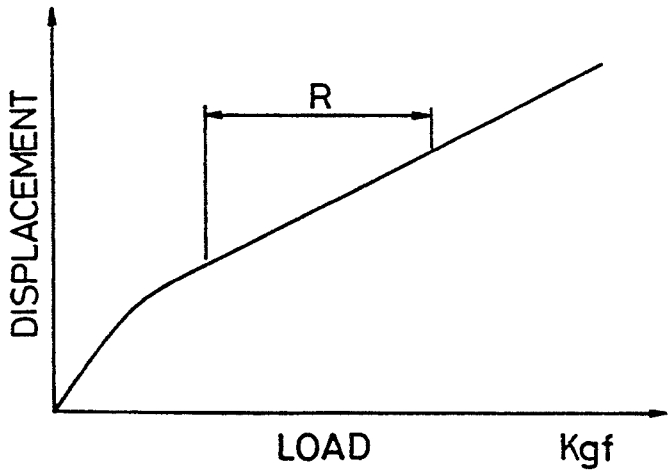
FIG. 8 is a graph showing the characteristic of displacement of the bearings in response to load.

Referring to FIG. 8, the displacement characteristic of the bearings 48 with respect to load is shown. The displacement of the bearing 48 indicates the displacement of the axis of the outer race of the bearing 48 in relation to the axis of the inner race.

As it is obvious from FIG. 8, the displacement curve has a linear (although it is not completely linear but it is an almost-linear) proportional range R wherein the displacement is considered to increase in proportion to the increase in load.

In the case of the shredding device 18 in this embodiment, the initial air pressure applied to the air cylinders 56 and 57, i.e., the initial load applied to the bearing 48, is set for a value in the proportional range R. And the foregoing gap is defined under a condition where the displacement caused by the initial load is applied to the bearing 48. Hence, as previously described, it is possible to hold the foregoing gap accurately constant by increasing the air pressure of the air cylinders 56 and 57 according to the thermal expansion of the free rollers 42.

The free rollers 42 incorporate a plurality of heat pipes 52, and these heat pipes 52 are thermally connected to the radiating fins 51, and therefore, the heat of the free rollers 42 is effectively released through the heat pipes 52 and the radiating fins 51. Thus, in holding the foregoing gap constant, the load for increasing the pressure of the air cylinders 56 and 57 will be reduced.

The shredding blades 55 of the bladed drum 20 are periodically re-sharpened to maintain their sharpness. As the blades are resharpened, the circular trajectory of the edges of the shredding blades 55 drawn during the rotation of the bladed drum 20 decreases in diameter, resulting in an increase of the gap.

In the case of the embodiment, however, since the free rollers 42 are supported by the eccentric adjusting holders 45 via the bearings 48, the distance from the point of contact between the receiving drum 19 and the free rollers 42 to the axis of the drum shaft 36 can be changed by adjusting the angular positions of the adjusting holders 45 with respect to the rocking arms, thus permitting easy adjustment of the dimension of the gap.

To adjust the adjusting holders 45, the connecting bolts 46, which connect the rocking arms with the adjusting holders 45, are removed and the adjusting holders 45 are turned by a specified rotational angle in relation to the rocking arms.

In the case of the embodiment, the temperature of one of the free rollers 42 is detected by the infrared thermometer 62 and the air pressure of both air cylinders 56 and 57 is controlled according to the detection result. It is also possible, however, to detect the temperatures of the free rollers 42 by separate infrared thermometers and to control the air pressure of each air cylinder independently in accordance with the detections results.

Additionally, the voltage-current converter 66 converts the input voltage Xi into the output current Xo according to the proportional control, but a controller which is designed to determine the output current by PID control including differential control and integral control in addition to the proportional control may be used in place of the voltage-current converter.

What is claimed is:

1. A shredding device for paper web used in the manufacture of cigarettes with filters, comprising:

a first drum rotatably arranged and having a peripheral surface for carrying paper web as it rotates; and shredding means for shredding the paper web into paper pieces of a specified length in cooperation with said first drum, said shredding means including a common shaft rotatably arranged in parallel to said first drum and having both ends, the second drum mounted on said common shaft and rotated with said common shaft in the opposite direction from said first drum, a pair of free rollers rotatably mounted on said common shaft at both sides of said second drum and having a larger outside diameter than said second drum, said pair of free rollers being rotated while contacting the peripheral surface of said first drum, mounting means for mounting the free rollers on said common shaft, said mounting means permitting the displacement of the axes of the free rollers with respect to the axis of said common shaft, a plurality of shredding blades which are arranged circumferentially on the peripheral surface of said second drum at equal intervals, said shredding blades passing said first drum with a specified gap between themselves and the peripheral surface of said first drum as said second drum is rotated, and shredding the paper web on said first drum into individual paper pieces while passing, supporting means for supporting said second drum and said pair of free rollers so that they are allowed to move toward or away from the peripheral surface of said first drum, and urging means for urging said second drum and said pair of free rollers toward the peripheral surface of said first drum, said pair of free rollers being pressed against the peripheral surface of said first drum with a specified force, detecting means for detecting a parameter of said free rollers, and controlling means for determining, from said parameter, an increase in the outside diameter of said free rollers, and controlling the urging force of said urging means in accordance with an increase in the outside diameter of said free rollers, and adjusting an eccentric distance between the axes of said free rollers and the axis of said common shaft by means of said mounting means.

2. The device according to claim 1, wherein said supporting means includes a fixed shaft, which is arranged in parallel to said common shaft, and a pair of supporting arms rotatably supported on the fixed shaft at one ends thereof, the both ends of said common shaft are rotatably supported on the other ends of the supporting arms.

3. The device according to claim 2, wherein said urging means includes a pair of pushers, which are in contact with the supporting arms, and a pair of air cylinders, which press the support arms toward the first drum via the these pushers.

4. The device according to claim 3, wherein said mounting means includes bearings provided between said common shaft and free rollers, these bearings having characteristics that displace the axes of the free rollers in relation to the axis of said common shaft when the peripheral surfaces of the bearings are subjected to an external force by said urging means.

5. The device according to claim 4, wherein said mounting means further includes eccentric rings provided between said common shaft and said bearings, the eccentric rings being mounted eccentrically to said common shaft.

6. The device according to claim 5, wherein said mounting means further includes adjusting means for adjusting an angular positions of the eccentric rings with respect to said common shaft.

7. The device according to claim 4, wherein said controlling means includes a pressure regulator for regulating the air pressure in the air cylinders.

8. The device according to claim 2, wherein said device further includes an Oldham coupling connected to one end of said common shaft to transmit motive power to said common shaft.

9. The device according to claim 1, wherein said detecting means includes a non-contact type infrared temperature sensor for detecting the temperature of the free rollers.

10. The device according to claim 1, wherein said device further includes a heat radiating means for radiating heat of the free rollers.

* * * * *